US009434000B2

(12) United States Patent
Tesoriere et al.

(10) Patent No.: US 9,434,000 B2
(45) Date of Patent: Sep. 6, 2016

(54) SYSTEM AND METHOD OF FORMING A SOLID CASTING

(71) Applicant: Retech Systems LLC, Ukiah, CA (US)

(72) Inventors: Tony Tesoriere, Ukiah, CA (US); Robin Lampson, Ukiah, CA (US)

(73) Assignee: RETECH SYSTEMS, LLC, Ukiah, CA (US)

( * ) Notice: Subject to any disclaimer, the term of this patent is extended or adjusted under 35 U.S.C. 154(b) by 76 days.

(21) Appl. No.: 14/515,469

(22) Filed: Oct. 15, 2014

(65) Prior Publication Data

US 2015/0101776 A1 Apr. 16, 2015

Related U.S. Application Data

(60) Provisional application No. 61/891,369, filed on Oct. 15, 2013.

(51) Int. Cl.

| | |
|---|---|
| ***B22D 27/06*** | (2006.01) |
| ***B22D 37/00*** | (2006.01) |
| ***B22D 7/00*** | (2006.01) |
| ***B22D 7/06*** | (2006.01) |
| ***B22D 41/015*** | (2006.01) |
| ***B22D 46/00*** | (2006.01) |

(52) U.S. Cl.

CPC . *B22D 7/00* (2013.01); *B22D 7/06* (2013.01); *B22D 7/064* (2013.01); *B22D 27/06* (2013.01); *B22D 37/00* (2013.01); *B22D 41/015* (2013.01); *B22D 46/00* (2013.01)

(58) Field of Classification Search

CPC ..... B22D 27/06; B22D 41/015; B22D 46/00

USPC ..... 164/451–454, 469, 495, 508, 445, 446

See application file for complete search history.

(56) References Cited

U.S. PATENT DOCUMENTS 2,768,074 A * 10/1956 Stauffer ..... C22B 34/129 164/495
3,186,043 A * 6/1965 Murtland, Jr. ..... C22B 4/00 164/457
3,672,428 A 6/1972 Tommaney (Continued)

FOREIGN PATENT DOCUMENTS

JP 2012-066970 A 4/2012
WO 2015/057888 A1 4/2015

OTHER PUBLICATIONS

International Search Report and Written Opinion mailed Feb. 23, 2015 in Int'l Patent Application No. PCT/US2014/060764, 11 pages.

*Primary Examiner* — Kevin E Yoon
(74) *Attorney, Agent, or Firm* — Kilpatrick Townsend & Stockton LLP

(57) ABSTRACT

A method and a system for forming a solid casting. A material is fed into a mold having a retractable bottom. A first portion of the material at a first, lower position within the mold is allowed to solidify to thereby form a portion of the casting. The retractable bottom is withdrawn downwards at a withdrawal rate. A second portion of the material at a second, upper position within the mold is maintained in a liquid state by application of heat thereto, using a plasma arc generated by a plasma arc torch. A voltage of the plasma arc is measured, and the withdrawal rate of the retractable bottom is controlled based on the voltage of the plasma arc.

21 Claims, 7 Drawing Sheets

(56) References Cited

U.S. PATENT DOCUMENTS 4,007,770 A * 2/1977 Timmons ..... B22D 23/10 164/495
4,149,582 A * 4/1979 Johansson ..... B22D 11/083 164/426
5,239,162 A * 8/1993 Haun ..... H05H 1/34 219/119
5,273,101 A 12/1993 Lillquist et al.
7,137,436 B2 * 11/2006 Jackson ..... B22D 11/001 164/469
7,617,863 B2 * 11/2009 Yu ..... F27B 3/04 164/154.1
2008/0179033 A1 7/2008 Jones

* cited by examiner

SYSTEM AND METHOD OF FORMING A SOLID CASTING

CROSS REFERENCE TO RELATED APPLICATION

This application claims priority to U.S. provisional Application Ser. No. 61/891,369, filed Oct. 15, 2013, entitled "VOLTAGE CONTROLLED WITHDRAWAL RAM IN PLASMA ARC MELTING APPLICATIONS," the disclosure of which is hereby incorporated by reference in its entirety.

BACKGROUND OF THE INVENTION

This invention relates generally to a system and method of forming a solid casting, and more particularly to forming an ingot while controlling the withdrawal rate of the ingot while the ingot is solidifying within a mold.

To form a metal ingot, molten metal is poured into a mold, where it subsequently freezes. One example of such a mold is a withdrawal crucible. In a withdrawal crucible, a puller forms the bottom of the mold at the start of the casting process. The puller is moved down within the mold as the metal is poured in the top.

In some withdrawal crucibles, the top portion of the metal is maintained in a molten state with a separate heater such as a plasma arc torch.

Such systems are generally described in Applicant's copending application Ser. No. 14/031,008, the disclosure of which is hereby incorporated by reference, and on Applicant's website at http://www.retechsystemsllc.com.

BRIEF SUMMARY OF THE DISCLOSURE

The following presents a simplified summary of some embodiments of the invention in order to provide a basic understanding of the invention. This summary is not an extensive overview of the invention. It is not intended to identify key or critical elements of the invention or to delineate the scope of the invention. Its sole purpose is to present some embodiments of the invention in a simplified form as a prelude to the more detailed description that is presented later.

A method and a system are provided, for forming a solid casting. A material is fed into a mold having a retractable bottom. A first portion of the material at a first, lower position within the mold is allowed to solidify to thereby form a portion of the casting. The retractable bottom is withdrawn downwards at a withdrawal rate. A second portion of the material at a second, upper position within the mold is maintained in a liquid state by application of heat thereto, using a plasma arc generated by a plasma arc torch. A voltage of the plasma arc is measured, and the withdrawal rate of the retractable bottom is controlled based on the voltage of the plasma arc.

The measured voltage may be a voltage between a power supply of the plasma arc torch and a ground. The ground may be measured at the casting.

The voltage may be indicative of a distance between the plasma arc torch and a top surface of the second portion of the material, such as by being directly proportional to the distance.

The control of the withdrawal rate may include filtering and/or processing a signal of the voltage, proportional control based on the voltage, integral control based on the voltage, derivative control based on the voltage, or combinations thereof.

The mold may be a crucible and the casting may be an ingot.

For a more complete understanding of the nature and advantages of the present invention, reference should be made to the ensuing detailed description and accompanying drawings.

DETAILED DESCRIPTION OF EXEMPLARY EMBODIMENTS

Throughout this description for the purposes of explanation, numerous specific details are set forth in order to provide a thorough understanding of the many embodiments disclosed herein. It will be apparent, however, to one skilled in the art that the many embodiments may be practiced without some of these specific details. In other instances, well-known structures and devices are shown in diagram or schematic form to avoid obscuring the underlying principles of the described embodiments.

In one exemplary method of forming a metal ingot, molten metal is poured into a mold with a movable plug or withdrawal ram disposed within it. At the beginning of the casting process, the molten metal impacts the ram and subsequently freezes to form the bottom of the ingot. As additional molten metal is poured into the top of the mold, the ram is withdrawn downwards.

For various reasons, it is often desirable to maintain a top portion of the metal within the mold in a molten state by using a heater, such as a plasma arc torch disposed above the top of the molten pool.

For various reasons, it is desirable to maintain the distance between the plasma arc torch and the top of the molten pool constant, which has heretofore been extremely difficult.

This distance has a rather linear correlation with the voltage of the plasma arc, i.e. the voltage drop between the power supply of the plasma arc torch and the ground. Thus, in the embodiments described herein, the withdrawal rate of the withdrawal ram is controlled based on the voltage of the plasma arc to maintain the distance between the plasma arc and the top of the molten pool constant. In other words, exemplary embodiments of the presently claimed invention use plasma arc voltage feedback to control a constant pool level in a withdrawal crucible while incoming molten material is filling the crucible and forming an ingot.

Figure 1A:
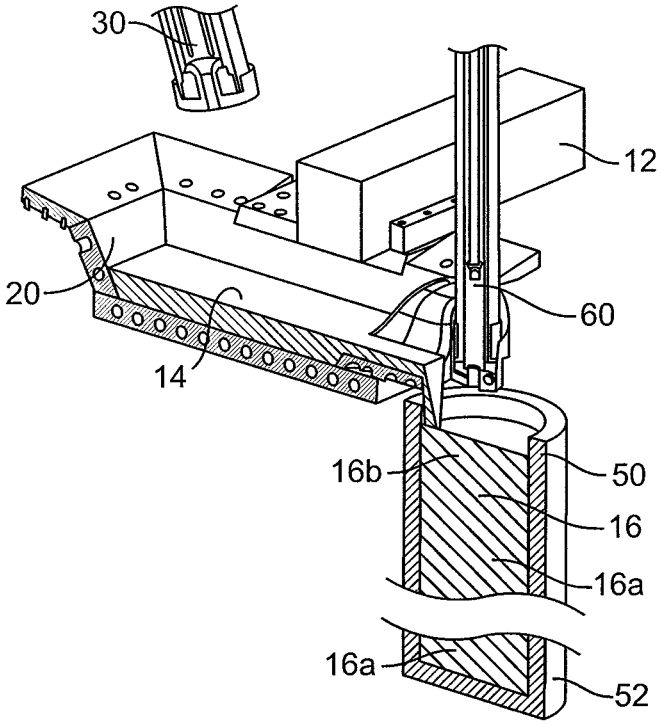
FIGS. 1A and 1B are simplified isometric, cutaway views of an exemplary system for feeding metal into a melting hearth, melting the metal, and pouring the metal into a withdrawal crucible.

In more detail, turning to FIG. 1A, in some embodiments, raw material 12 is fed to a melting hearth 20 where it is melted by a first heat source 30, which may be a plasma arc torch or any other appropriate heat source. The melted material 14 is then poured into a withdrawal crucible 50 where it is acted upon by a second heat source: a plasma arc torch 60. The material 16*a* in the lower portion of the crucible 50 solidifies to become a portion of what will later be the finished ingot, while the material 16*b* in the upper portion of the crucible 50 is maintained in the molten state by the plasma arc torch 60. The delineation between the solid 16*a* and molten 16*b* metal within the crucible 50 is not illustrated.

In exemplary embodiments, the mold 50 has a retractable bottom 52 which is moved downwards as the material 16 fills the mold to maintain the surface level substantially constant. The bottom 52 may be, for example, a near net fit dovetail joint or puller that occupies the crucible and forms the bottom at the start of the casting process. Molten metal 16 pours into the dovetail joint and freezes. As the level begins to fill in the crucible, the material 16*a* in contact with the dovetail puller 52 is allowed to solidify through, for example, a water cooling system integrated into the crucible. As the material 16 is fed into the crucible 50, the withdrawal position of the bottom 52 moves down in order to maintain a constant molten pool level position in the crucible.

Figure 6A:
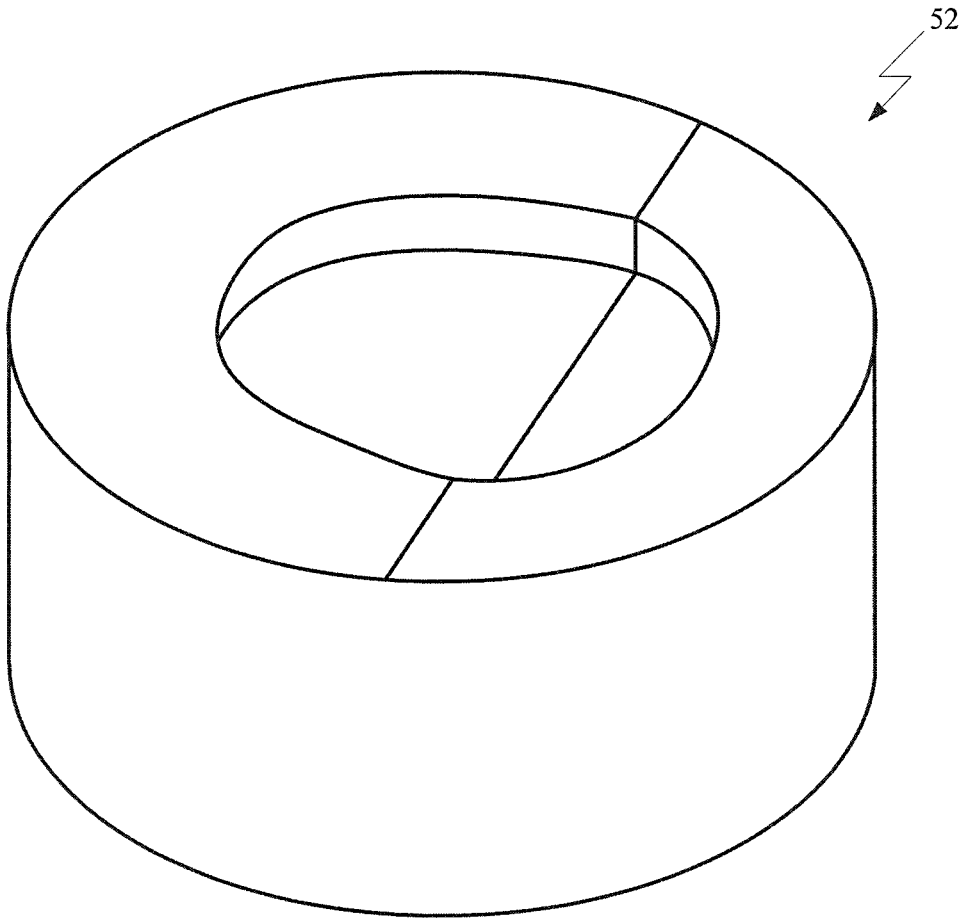
FIGS. 6A and 6B are simplified perspective views of two alternative exemplary dovetail pullers which form the bottom of an exemplary withdrawal crucible for use in the exemplary system.
Figure 6B:
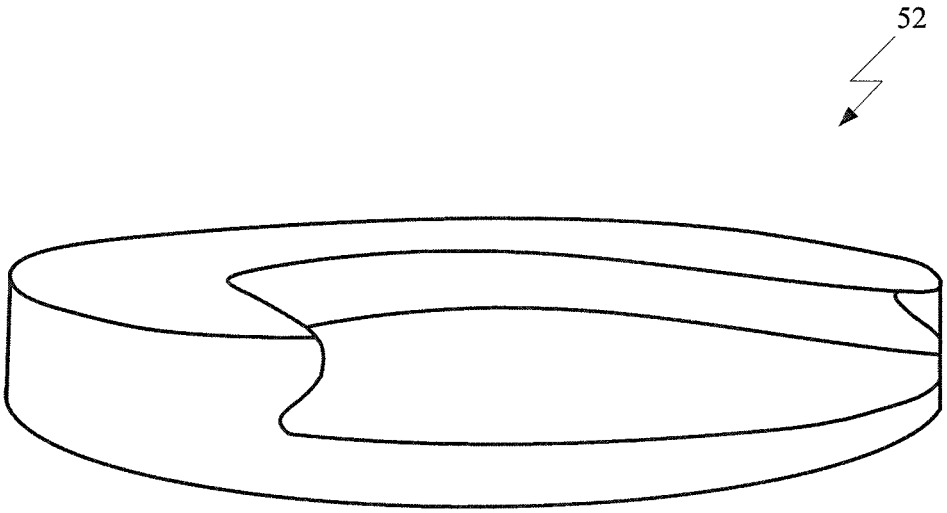

In more detail, as the molten metal 14 begins to flow into the mold 50, the molten metal flows into an undercut region that forms the part of the ingot that is gripped by the puller 52 to pull the ingot vertically downwards. There is either a way to separate two pieces of the puller 52, or there is a relief on one side allowing horizontal removal. In more detail yet, and referring to FIGS. 6A and 6B, the bottom 52 of the mold 50 may be a dovetail puller, such as a two-piece dovetail puller as shown in FIG. 6A, or alternatively, a one-piece dovetail puller as shown in FIG. 6B. The two halves of the two-piece puller shown in FIG. 6A may be bolted together and/or may be attached to one another with a hinge, so that they can be separated from one another to remove the finished ingot. The one-piece puller shown in FIG. 6B may have an open edge, as shown, to allow the finished ingot to be slid laterally out of the puller. The bottom 52 may include a base, a chill plate, and a dovetail plate. The puller base may be mounted to and receive cooling water from the water-cooled housing of the mold 50. The chill plate is mounted to the top of the puller base, while the copper dovetail plate 52 is mounted to the top of the chill plate. The dovetail plate 52 is undercut on its inside diameter to provide a relief for the ingot dovetail as liquid metal begins flowing into the mold 50.

In an ideal world, if equipment and operators were perfect, the feed rate of the material 12 into the hearth 20, the rate at which the raw material 12 is melted within the hearth 20 to form the melted material 14, the rate at which the melted material 14 is poured from the hearth 20 into the crucible 50 to form the ingot 16, and the rate at which the ingot material 16 is withdrawn downwards within the crucible 50 would all be equal to one another. In other words, the liquid pour rate into the crucible would be smooth, steady, and continuous. The withdrawal rate would be identical to the pour rate, and the liquid level within the crucible 50 would be exactly constant over time.

Figure 1B:
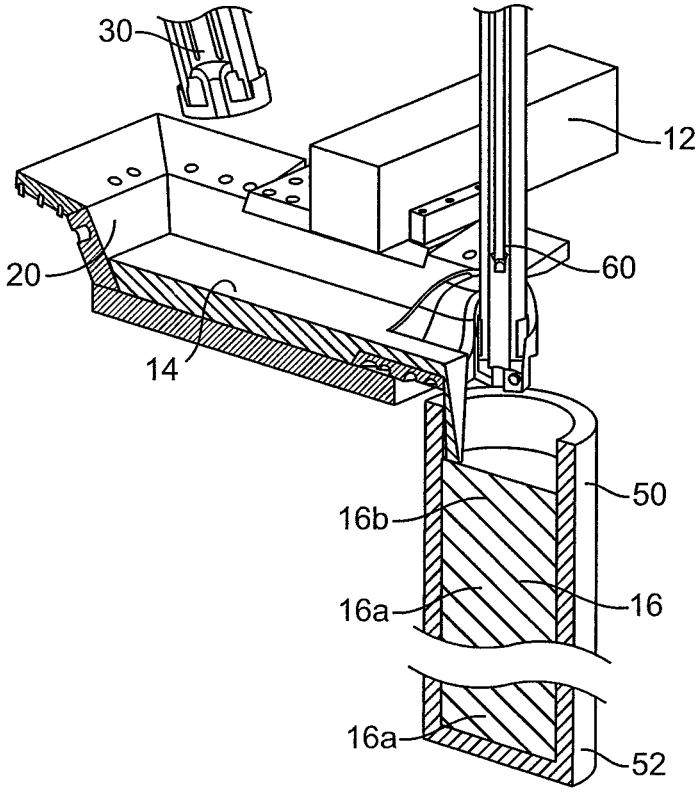

However, turning to FIG. 1B, the liquid level within the crucible 50 has previously been difficult to measure because of heat, bright light, and dust. Therefore, in the typical prior art, the liquid level often varies. In the example of FIG. 1B, the withdrawal of the ingot 16 has outpaced the pouring of the material 14 into the crucible 50, and the liquid level of the top of the molten portion 16*b* is lower than ideal. Known systems have attempted to use non-contact devices such as lasers, ultrasound, and optical vision equipment, with mixed results. Even with viewport purges and brushes, the "view" for such devices can be disturbed by dust, pitting of glass, etc. Generally, the effectiveness of these systems has been poor compared to the cost of equipment, maintenance, and implementation. Traditionally, operators have been required to monitor liquid levels through video camera views—at least as a backup to automation attempts.

Figure 2:
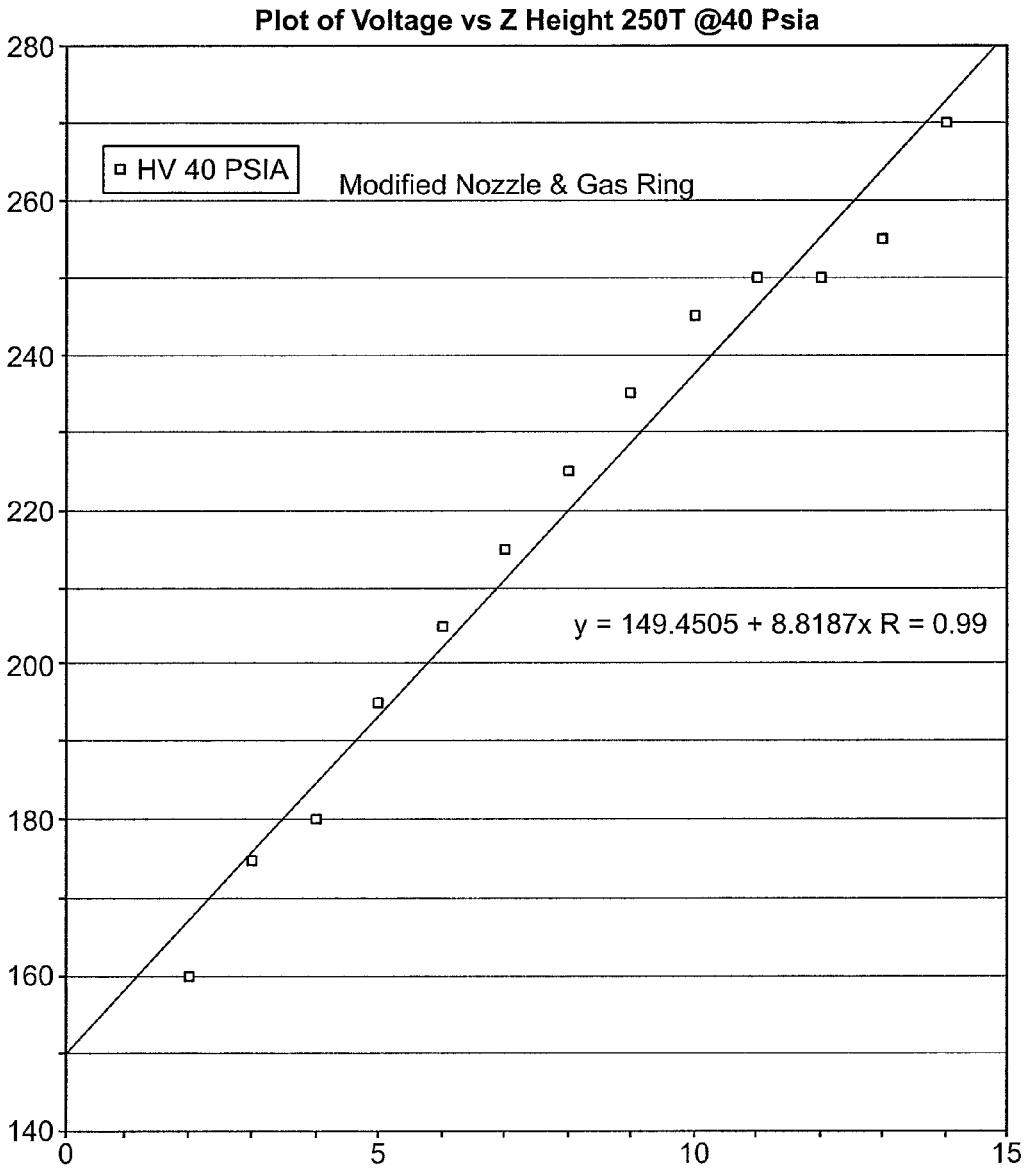
FIG. 2 illustrates the linear correlation between standoff height and voltage of a plasma arc torch.

Turning to FIG. 2, there is a rather linear correlation between the torch standoff (Z-height) and the torch voltage when as plasma arc torch is used as the heat source 60. This correlation is generally discussed in Applicant's U.S. Pat. No. 5,239,162, the disclosure of which is hereby incorporated by reference. This correlation means that the plasma arc torch voltage could be used as a way to measure the distance from the torch to the liquid surface in the crucible. Once the torch height or torch pattern height has been set, an algorithm is used to process the signal and thereby smooth the signal for control purposes. The withdrawal rate is controlled based on the smoothened signal, thereby maintaining the liquid level constant.

The plasma arc voltage is measured in the electrical connection between the power supply and the ingot ground. The voltage of the arc is proportional to the distance from the start of the arc to the top molten surface of the solidifying ingot, and therefore can be used to measure the height of the top of the molten pool 16*b* in real time. This voltage is used in a closed loop feedback control system to adjust the ingot withdrawal rate and control the molten pool level in the crucible by maintaining a target voltage.

Figure 3A:
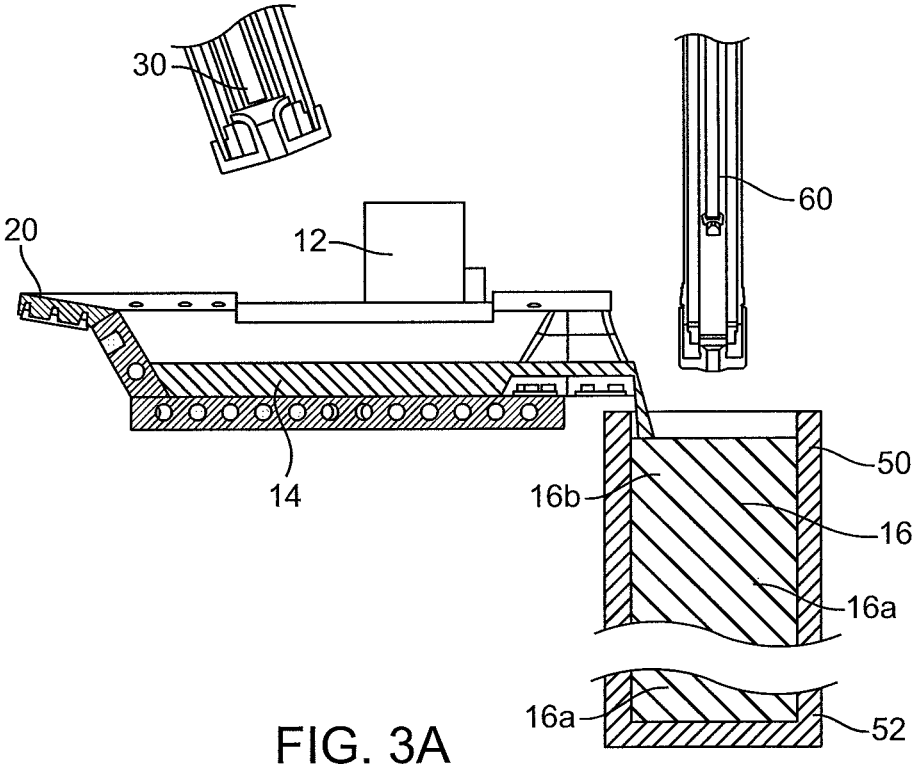
FIGS. 3A and 3B are simplified cross-sectional views of the system of FIGS. 1A and 1B.
Figure 3B:
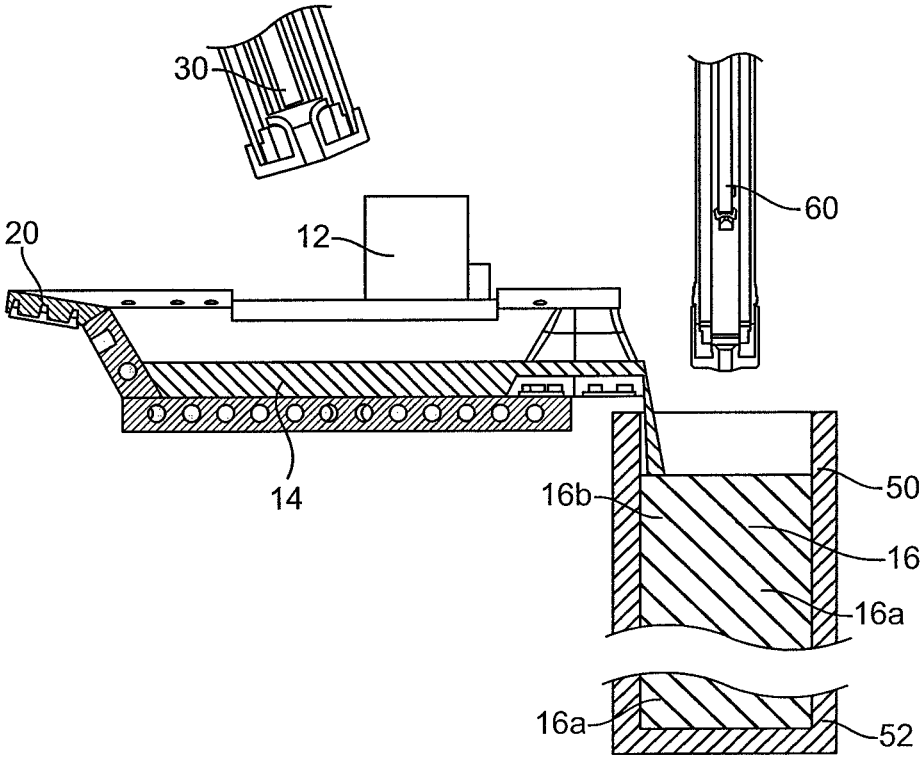

In other words, referring back to FIGS. 1A and 1B, and also to FIGS. 3A and 3B, if the withdrawal rate starts to outpace the melting and pouring rates as shown in FIGS. 1B and 3B, the control system notes the corresponding change in voltage and responds by slowing the withdrawal rate. Conversely, if the melting and pouring rates start to outpace the withdrawal rate, the control system notes the corresponding change in voltage and responds by speeding the withdrawal rate.

In a presently preferred embodiment, the control system processes the voltage signal and subsequently uses proportional-integral-derivative (PID) control, but any appropriate control system may be used. The signal processing may include filtering, such as with a linear filter, a non-linear filter, a time-variant filter, a time-invariant filter, a causal filter, a non-causal filter, an analog filter, a digital filter, a discrete-time filter, a continuous-time filter, a passive type of continuous-time filter, an active type of continuous-time filter, an infinite impulse response type of filter, or a finite impulse response type of filter.

Figure 4:
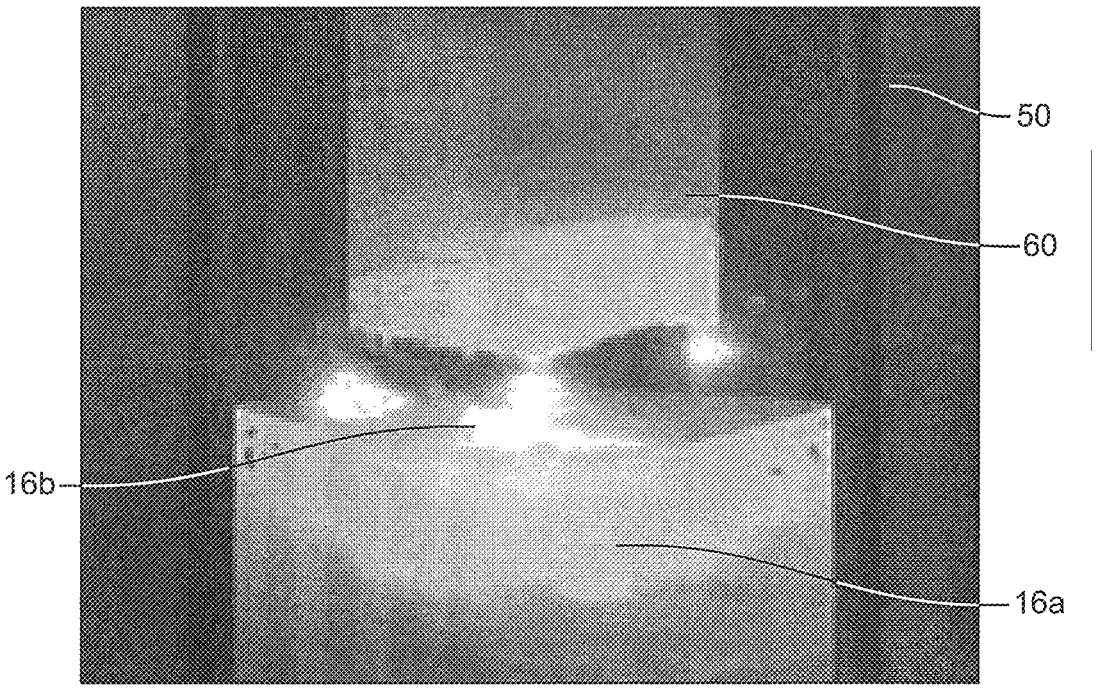
FIG. 4 is a photograph of the exemplary system.

FIG. 4 is a photograph showing an exemplary embodiment of the system during use. In this embodiment, the crucible 50 is water-cooled to solidify the bottom portion of the ingot 16*a*. The molten pool 16*b* can be seen as a bright spot at the top of the solidified ingot 16*a*.

Figure 5:
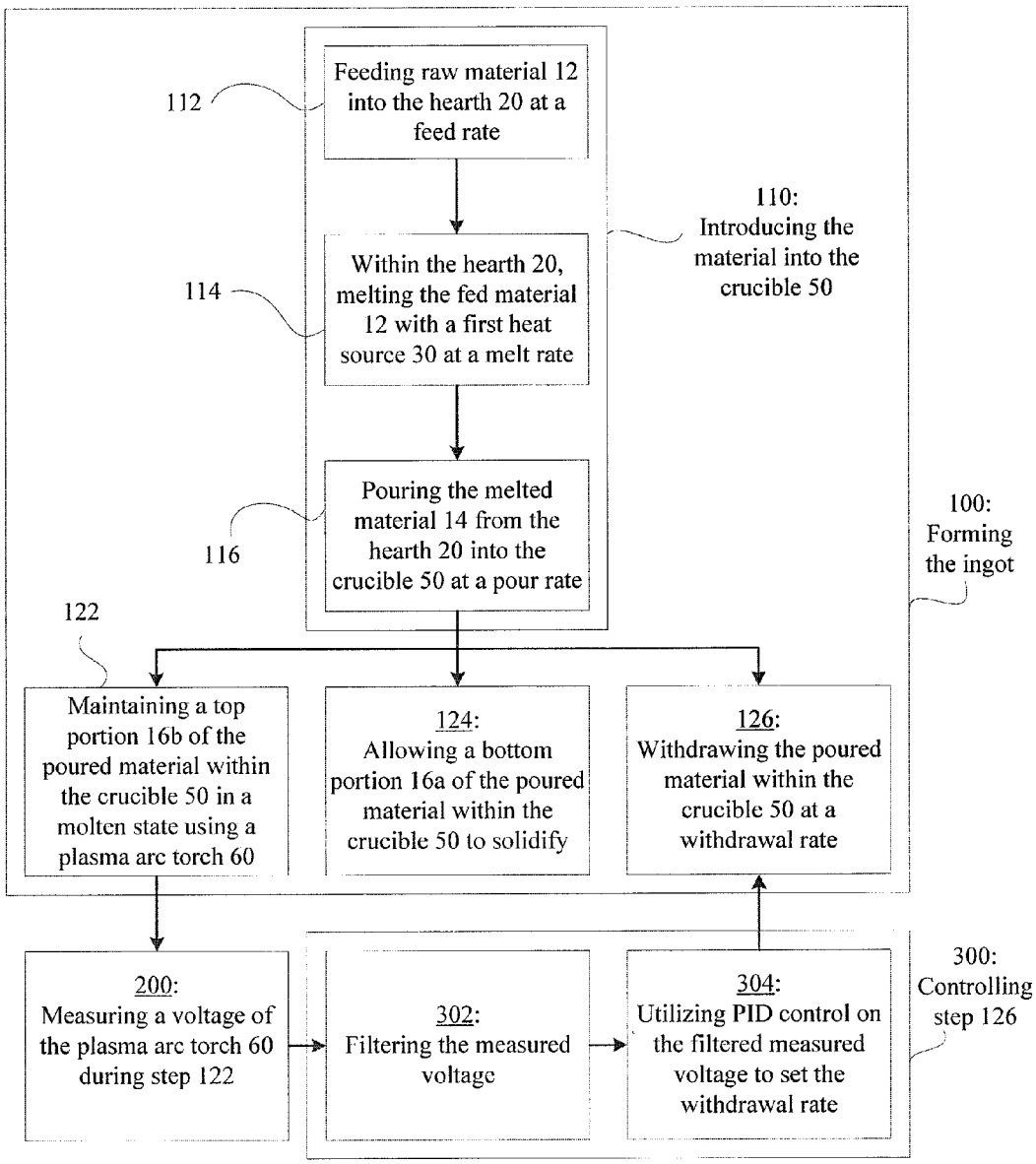
FIG. 5 is a flow chart of an exemplary method of forming an ingot.

Still more detail of an exemplary method is shown in FIG. 5. In its broadest form, the exemplary method includes three steps: step 100: forming the ingot; step 200: measuring the voltage of the plasma arc torch; and step 300: controlling at least one aspect of the forming step 100 based on the voltage measured in step 200.

In more detail, step 100 of forming the ingot includes step 110 of introducing the material 12, 14 into the crucible 50; step 122 of applying heat to the top portion 16*b* of the material using the plasma arc torch 60; step 124 of allowing the bottom portion 16*a* of the material to solidify; and step 126 of withdrawing the material downwards within the crucible 50. Step 110 can be further subdivided into step 112 of feeding the raw material 12 into the hearth 20; step 114 of melting the fed raw material 12 with the first heat source 30 within the hearth 20 to form the molten material 14; and step 116 of pouring the molten material 14 from the hearth 20 into the crucible 50.

It will be appreciated that the system and method heretofore described provide at least the following benefits: No extra hardware is required, other than changes to the control system to adjust the withdrawal rate in response to changes in voltage, which are indicative of changes in liquid level. In other words, an existing system can be retrofitted to implement the exemplary method, simply by updating the control system. The feed mechanism, melting hearth, plasma arc torches, and mold with associated movable bottom need not be changed. Runout and overflow are avoided, leading to higher quality finished products and less waste. The surface finish may be of higher quality. Furthermore, the complete automation of the withdrawal rate frees up operators to concentrate on the feeding, melting, and refining steps, which will result in much less human error.

In simulations, even using arc voltage noises of an atypical +−50 volts, the Applicant predicts control of the liquid level position to within 2 mm of target or better.

Velocity corrections are made automatically by the controller to adapt to varying melt rate conditions. In other words, when the pour rate starts to outpace the withdrawal rate, the withdrawal rate is sped up, and when the withdrawal rate starts to outpace the pour rate, the withdrawal rate is slowed down. Because the pour rate depends on the earlier steps, this method compensates not only for variations in the pour rate, but indirectly compensates for any variation upstream in the process, for example, the feed rate of the raw material 12, and the melt rate of the raw material 12 into the molten material 14; as well as directly compensating for variation in the pour rate of the molten material 14 into the mold 50. This exemplary withdrawal system has the ability to facilitate fully automatic withdrawal positioning without other external sensors or human intervention to monitor for overflow or low level conditions.

A system of this nature can be used to control the liquid metal level not only in continuous hearth melting systems, but also any system where liquid metal is fed into a container that is heated by a plasma torch. For example, another embodiment of the invention provides a semi continuous casting cold wall induction system where material is melted and mixed in a water cooled copper hearth, then the hearth is tilted to pour metal into the cold wall induction crucible for casting. Yet another embodiment provides a system where material is melted and mixed in a water cooled copper hearth, then the hearth is tilted to pour metal into a plasma heated tundish.

The above description is illustrative and is not restrictive, and as it will become apparent to those skilled in the art upon review of the disclosure, that the present invention may be embodied in other specific forms without departing from the essential characteristics thereof For example, any of the aspects described above may be combined into one or several different configurations, each having a subset of aspects. These other embodiments are intended to be included within the spirit and scope of the present invention. The scope of the invention should, therefore, be determined not with reference to the above description, but instead should be determined with reference to the following and pending claims along with their full scope of equivalents.

What is claimed is:

1. A method of forming a solid casting, comprising:
feeding a material into a mold, the mold comprising a retractable bottom;
allowing a first portion of the material at a first, lower position within the mold to solidify, to thereby form a portion of the casting;
withdrawing the retractable bottom downwards at a withdrawal rate;
maintaining a second portion of the material at a second, upper position within the mold in a liquid state by applying heat to the second portion of the material using a plasma arc generated by a plasma arc torch;
measuring a voltage of the plasma arc; and
controlling the withdrawal rate of the retractable bottom based on the voltage of the plasma arc.

2. The method of claim 1, wherein the measured voltage is a voltage between a power supply of the plasma arc torch and a ground.

3. The method of claim 2, wherein the ground is measured at the casting.

4. The method of claim 1, wherein the voltage is indicative of a distance between the plasma arc torch and a top surface of the second portion of the material.

5. The method of claim 4, wherein the voltage is directly proportional to the distance between the plasma arc torch and the top surface of the second portion of the material.

6. The method of claim 1, wherein controlling the withdrawal rate comprises at least one member of the group consisting of: processing a signal of the voltage, filtering the voltage signal, proportional control based on the voltage signal, integral control based on the voltage signal, derivative control based on the voltage signal, and combinations thereof.

7. The method of claim 1, wherein the mold is a crucible and the casting is an ingot.

8. The method of claim 1, further comprising:
forming a portion of the casting by controlling the step of forming the portion of the casting based on the voltage of the plasma arc.

9. The method of claim 8, wherein controlling the step of forming the portion of the casting comprises at least one member of the group consisting of: processing a signal of the voltage, filtering the voltage signal, proportional control based on the voltage signal, integral control based on the voltage signal, derivative control based on the voltage signal, and combinations thereof.

10. The method of claim 1, wherein the controlling step comprises controlling at least one of: the feeding, the allowing to solidify, the withdrawing, and the maintaining.

11. The method of claim 10, wherein the controlling step comprises controlling a rate of the at least one of: the feeding, the allowing to solidify, the withdrawing, and the maintaining.

12. The method of claim 1, wherein the feeding step comprises:
providing the material into a hearth;
melting the material that has been fed into the hearth; and
pouring the material that has been melted from the hearth into the mold.

13. The method of claim 12, wherein the controlling step comprises controlling at least one of: the feeding, the melting, the pouring, the allowing to solidify, the withdrawing, and the maintaining.

14. The method of claim 13, wherein the controlling step comprises controlling a rate of the at least one of: the feeding, the melting, the pouring, the allowing to solidify, the withdrawing, and the maintaining.

15. The method of claim 1, wherein withdrawing the retractable bottom downwards comprises pulling downwards with a dovetail puller.

16. A solid casting forming system, comprising:

a mold comprising a retractable bottom configured to be withdrawn downwards, the mold being configured for a material to be introduced therein, and for a first portion of the material at a first, lower position within the mold to solidify, to thereby form a portion of the casting;

the retractable bottom having a dovetail puller configured to occupy a portion of the lower position in which the casting starts formation;

a plasma arc torch configured and positioned relative to mold to generate a plasma arc and thereby apply heat to a second portion of the material at a second, upper position within the mold to thereby maintain the second portion of the material in a liquid state; and a controller configured to measure a voltage of the plasma arc and to control the forming the portion of the casting based on the voltage of the plasma arc.

17. The system of claim 16, wherein the measured voltage is a voltage between a power supply of the plasma arc torch and a ground.

18. The system of claim 17, wherein the controller is further configured to measure the ground at the casting.

19. The system of claim 16, wherein the measured voltage is indicative of a distance between the plasma arc torch and a top surface of the second portion of the material.

20. The system of claim 19, wherein the measured voltage is directly proportional to the distance between the plasma arc torch and the top surface of the second portion of the material.

21. The system of claim 16, wherein the mold is a crucible and the casting is an ingot.

* * * * *